US005263708A

United States Patent [19]

Hacknauer

[11] Patent Number: 5,263,708

[45] Date of Patent: Nov. 23, 1993

[54] PAPER-GUIDING DEVICE IN A FINISHER UNIT FOR COPY SHEETS

[75] Inventor: Frank Hacknauer, Honeoye Falls, N.Y.

[73] Assignee: Eastman Kodak Company, Rochester, N.Y.

[21] Appl. No.: 854,034

[22] Filed: Mar. 19, 1992

[30] Foreign Application Priority Data

Jul. 16, 1991 [DE] Fed. Rep. of Germany ..... 4123499

[51] Int. Cl.[5] ..... B65H 39/10

[52] U.S. Cl. ..... 271/303; 493/419; 493/420; 493/421; 270/52

[58] Field of Search ..... 270/52, 54; 271/303; 493/419, 420, 421

[56] References Cited

U.S. PATENT DOCUMENTS

| | | | |
|---|---|---|---|
| 2,750,186 | 6/1956 | Bruneau et al. | 271/303 |
| 4,925,178 | 5/1990 | Clabbers et al. | 271/303 |
| 5,020,784 | 6/1991 | Asami et al. | 270/53 |
| 5,080,340 | 1/1992 | Hacknauer et al. | 270/37 |

*Primary Examiner*—Edward K. Look
*Assistant Examiner*—Gregory Bulla
*Attorney, Agent, or Firm*—Lawrence P. Kessler

[57] ABSTRACT

In a finisher unit 1, two rectilinear guide channels 9, 16 are arranged which cross each other at an acute angle ($\alpha$). In the area of the point of intersection 19 of the guide channels 9, 16, a plurality of deflectors 24 are arranged which, under the action of gravity, cover the steeply inclined guide channel 16 such that they extend into the transport path of the sheets guided therein. The pivotally mounted deflectors 24 are pivoted counter-clockwise by an arriving sheet and thus are transferred to a position in which they close the transverse guide channel 9,9*b* such that they form a guiding surface connecting guide channel 16 across the point of intersection 19. The deflectors 24 which are mounted outside the guide channels 9,16 extend through recesses 9*d*, 16*a*, 16*c*, 16*d* into the channels and are limited in their end positions by end faces 9*a* and 16*b*respectively of the guide channels 9 and 16 respectively. In order that the sheets can also be smoothly guided across the point of intersection 19 in the second, transverse guide channel 9, such channel is provided with a funnel-shaped constriction 9*c* upstream of the point of intersection 19 and with a funnel-shaped flared portion 9*b* downstream of the point of intersection 19.

7 Claims, 4 Drawing Sheets

PAPER-GUIDING DEVICE IN A FINISHER UNIT FOR COPY SHEETS

BACKGROUND OF THE INVENTION

The invention relates in general to a paper-guiding device for use in a finisher unit for copy sheets fed seriatim to the finisher unit by a reproduction apparatus, and more particularly to a paper-guiding device including two rectilinear guide channels which join each other at an angle and in which the sheets are transported by driven rollers.

A finisher unit for copy sheets fed seriatim from a reproduction apparatus as shown in U.S. Pat. No. 5,080,340(issued Jan. 14, 1992 in the same of Hacknauer et al.). Such apparatus includes two reclinear guide channels which join and cross each other at an angle. Under certain circumstances (e.g., a severely curled sheet), a sheet mass enters the wrong path at the intersection between the paths.

In a known paper-guiding device shown in DE-39 32 070-A1, a control-label deflecting element is arranged in the area where two guide channels terminate in each other at an angle. This device prevents sheets from escaping into the laterally terminating guide channel when it is in its position associated with a rectilinear channel. However, this would not apply to crossing channels.

SUMMARY OF THE INVENTION

This invention is directed to a paper-guiding device in which, even when the guide channels cross each other, an undisturbed transport is ensured in a simple manner. According to the invention, the guide channels cross each other at an acute angle and in that in the area of a point of intersection of the two guide channels, at least one pivotally mounted deflector is provided, the deflector extends transversely to the channels and covers the first guide channel. The deflector can be pivoted into a position in which it clears the first guide channel and closes the second guide channel.

According to a modification of the invention, the deflector extends, under the action of gravity, into the transport path of the sheets guided in the first guide channel and is pivoted by the arriving sheets in the transport direction such that it forms a guide surface for connecting the guide channel across the point of intersection when the deflector is in the position in which it closes the second guide channel. Accordingly, the sheets can advantageously pass the point of intersection as desired in spite of the relatively long interruption between the exit from, and the return into the first guide channel, which is caused by the arrangement of the guide channels at an acute angle to each other.

Advantageously, a plurality of deflectors is provided which are distributed over the width of the sheets and mounted for rotation about a journal and which are mounted outside the guide channels and are received in recesses thereof. The deflectors extend over the whole width of the first guide channel and are pivoted, in opposition to their force of gravity, directly in front of the sheet supplied such that they clear the first guide channel and cover the second guide channel. Accordingly, the sheets are guided without disturbance across the point of intersection. In order that the sheets may also be safely guided across the point of intersection in the transversely disposed, second guide channel, such channel is provided with a funnel-shaped constriction upstream of the point of intersection and with a funnel-shaped flared portion downstream of the point of intersection.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENT

Figure 1:
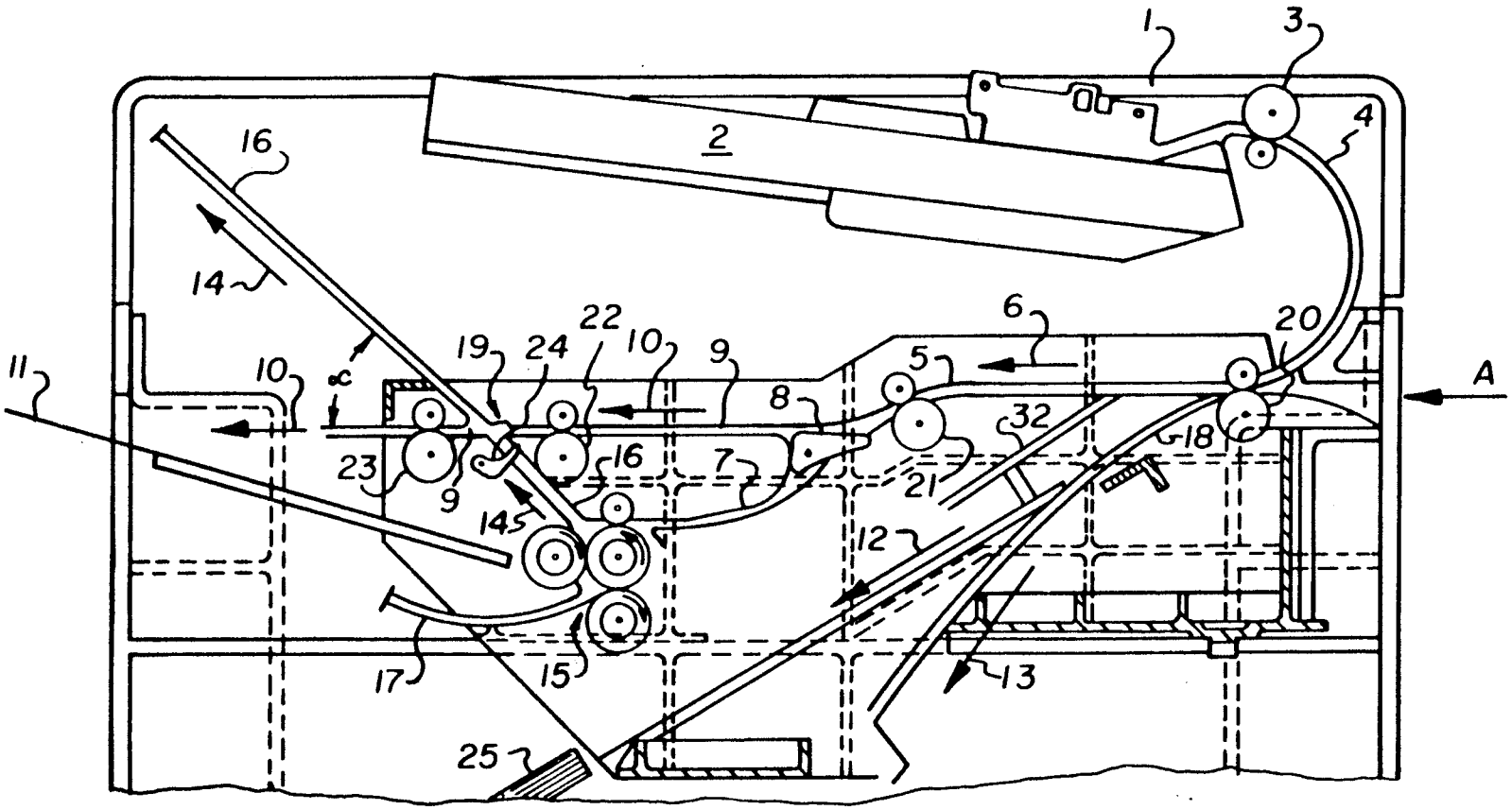
FIG. 1 is a lateral view of a portion of a finisher unit including the paper-guiding device according to this invention in a position in which the sheets fed to the finisher unit are directly guided to a previewing station.

The paper-guiding device according to the invention is part of a unit attached to a copier for further finishing of copy sheets fed seriatim to the unit by the copier. The finisher unit provides for a great number of finishing operations to be performed such as collecting and stacking in sets, stapling, Z-folding, spine-stapling and folding in half, insertion of cover and slip sheets as well as previewing of the copy sheets supplied, for example. Only such components of the finisher units as are necessary to understand the invention are shown.

A finisher unit 1 is directly connected to a reproduction apparatus such as a copier (not illustrated). Copy sheets fed seriatim from the reproduction apparatus to the unit 1 from the direction of the arrow "A", or sheets or foils taken from a feeding tray 2, are finished in a manner to be described further below. The individual finishing steps are preselected from the control panel of the reproduction apparatus. The sheets from the reproduction apparatus are transported alternatively in guide channels 5 and 9 by transport rollers 20, 21, 22, 22 in the direction of the arrows 6, 10 into a previewing station 11 (see FIG. 1); or in guide channels 5 and 7 by transport rollers 20, 21 in the directions of the arrows 6 and 14 into a buckle-folding device 15 (see FIG. 2). A pivotal switch 8 is associated with the guide channels 5, 7 and 9. In the position illustrated in FIG. 1, the switch 8 directs a sheet arriving through guide channel 5 in the direction of the arrow 6 into guide channel 9. The sheet in guide channel 9 is transported in the direction of the arrow 10 and fed by a pair of transport rollers 23 to a previewing station 11 where the copy quality can be checked. After any possible correction has been made at the reproduction apparatus, the actual finishing operation can be started.

Figure 2:
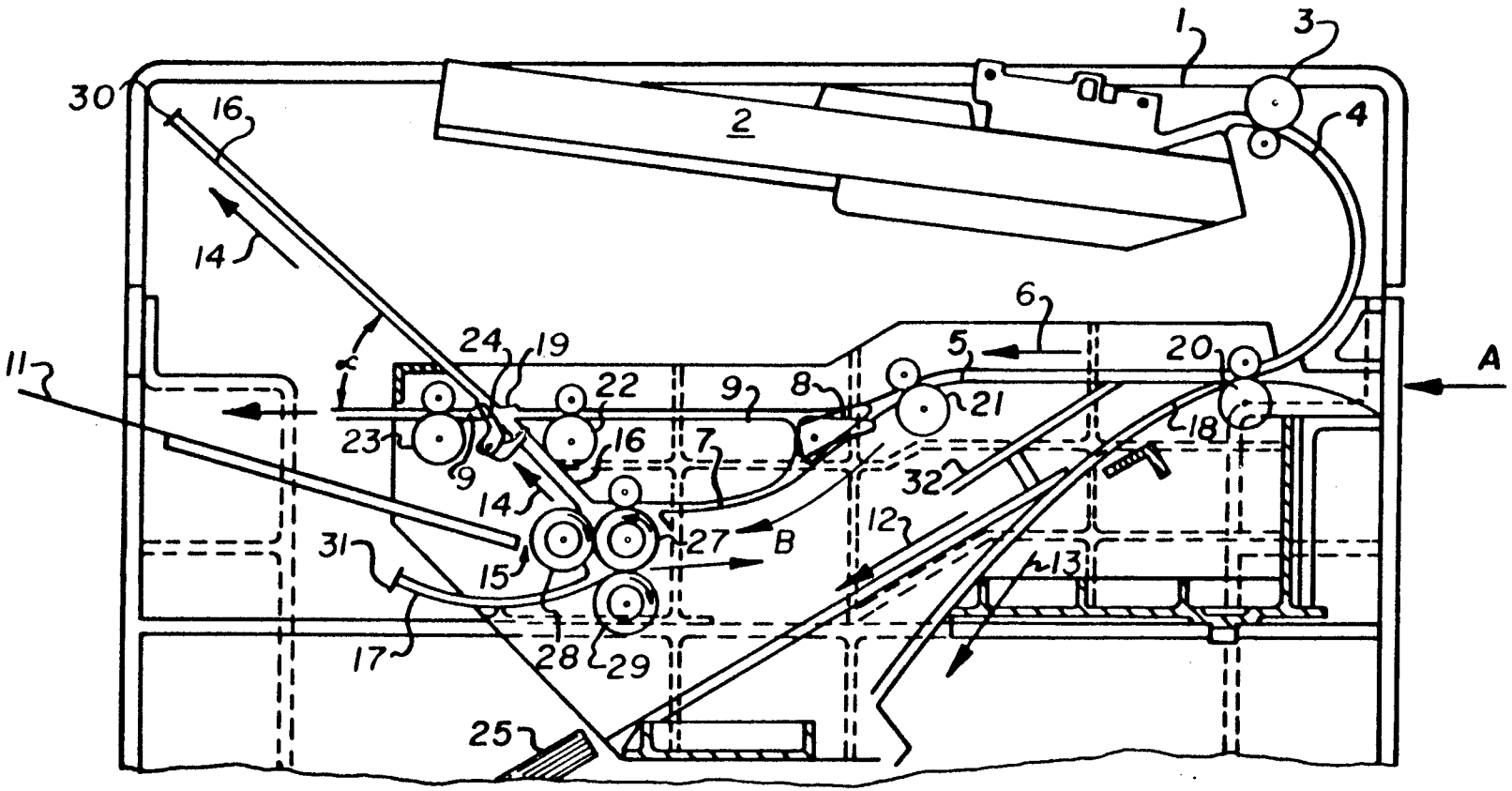
FIG. 2 is a lateral view, similar to FIG. 1, with the paper-guiding device in a position in which the sheets are fed to a buckle-folding device.

If the Z-folding function is preselected, switch means 8 is set to the position illustrated in FIG. 2 in which a sheet arriving in the direction of the arrow 6 is deflected into guide channel 7 where such sheet is guided to the folding rollers 27 of buckle-folding device 15. The folding rollers 27 first transport the sheet in the direction of the arrow 14 into a long guide channel 16 until the sheet contacts an abutment 30. The folding rollers 27 which continue their transport action compress the sheet so that it buckles in the area of the folding rollers 27, 28, with a loop forming in a known manner in the area of the folding rollers 27, 28, which is engaged by the nip of such rollers. The sheet is thus folded for the first time and is transported in opposition to the direction of the arrow 14 into an equally narrow but shorter guide channel 17 until it contacts an abutment 31. The folding rollers 27 and 28 which continue their transporting action cause another buckling of the sheet. The resultant loop is moved into the nip of the folding rollers 27, 29 which produce the second fold. The sheet now having a Z-fold, is fed out by the rollers 27, 29 in the direction of the arrow "B". After having left the folding rollers 27, 29, the folded sheet slides, under the action of gravity, in the direction of the arrow 12 to an abutment (not illustrated) where a stack 25 of deposited sheets is formed.

Figure 3:
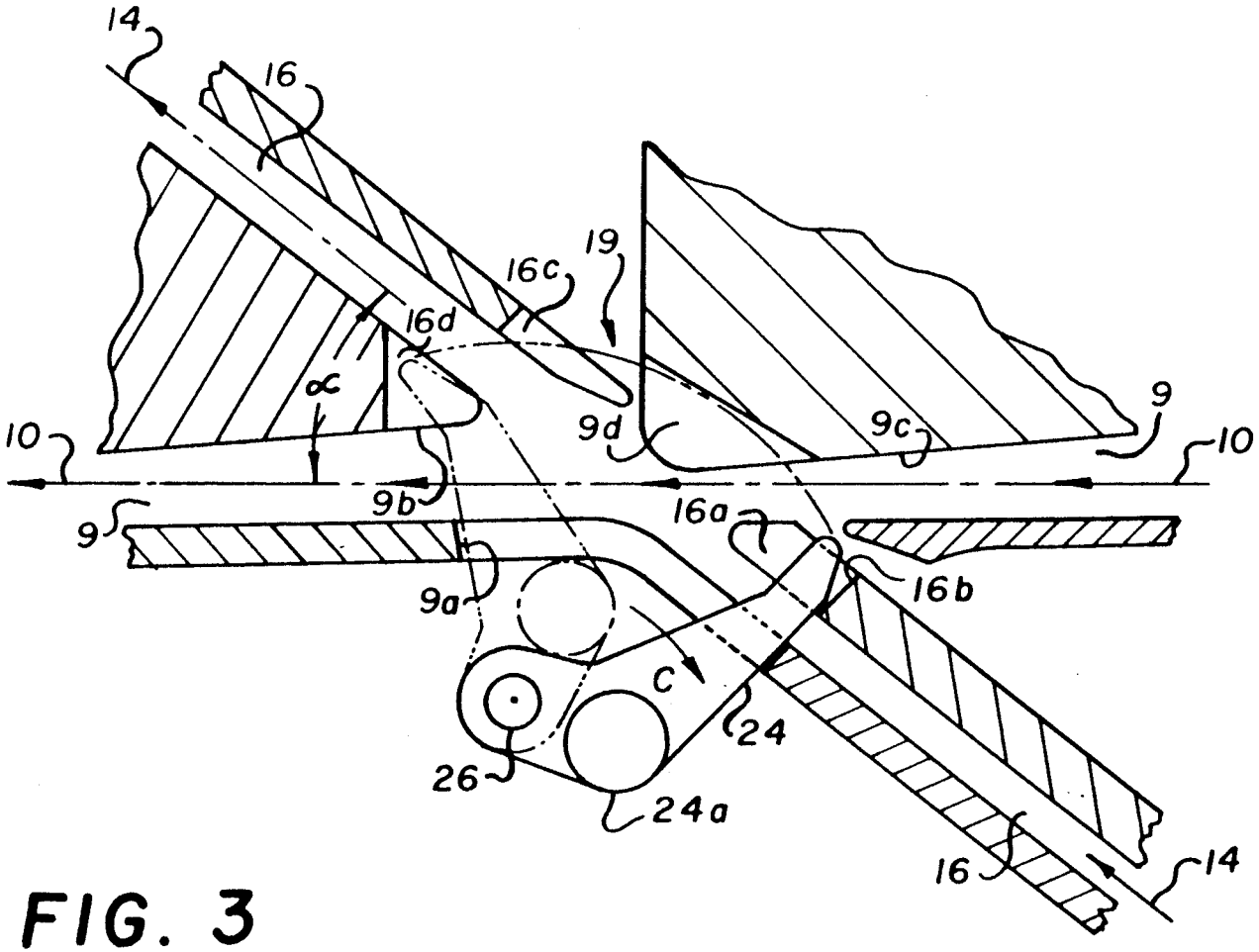
FIG. 3 is an enlarged partial view of the paper-guiding device functioning with sheets directly guided to a previewing station.
Figure 4:
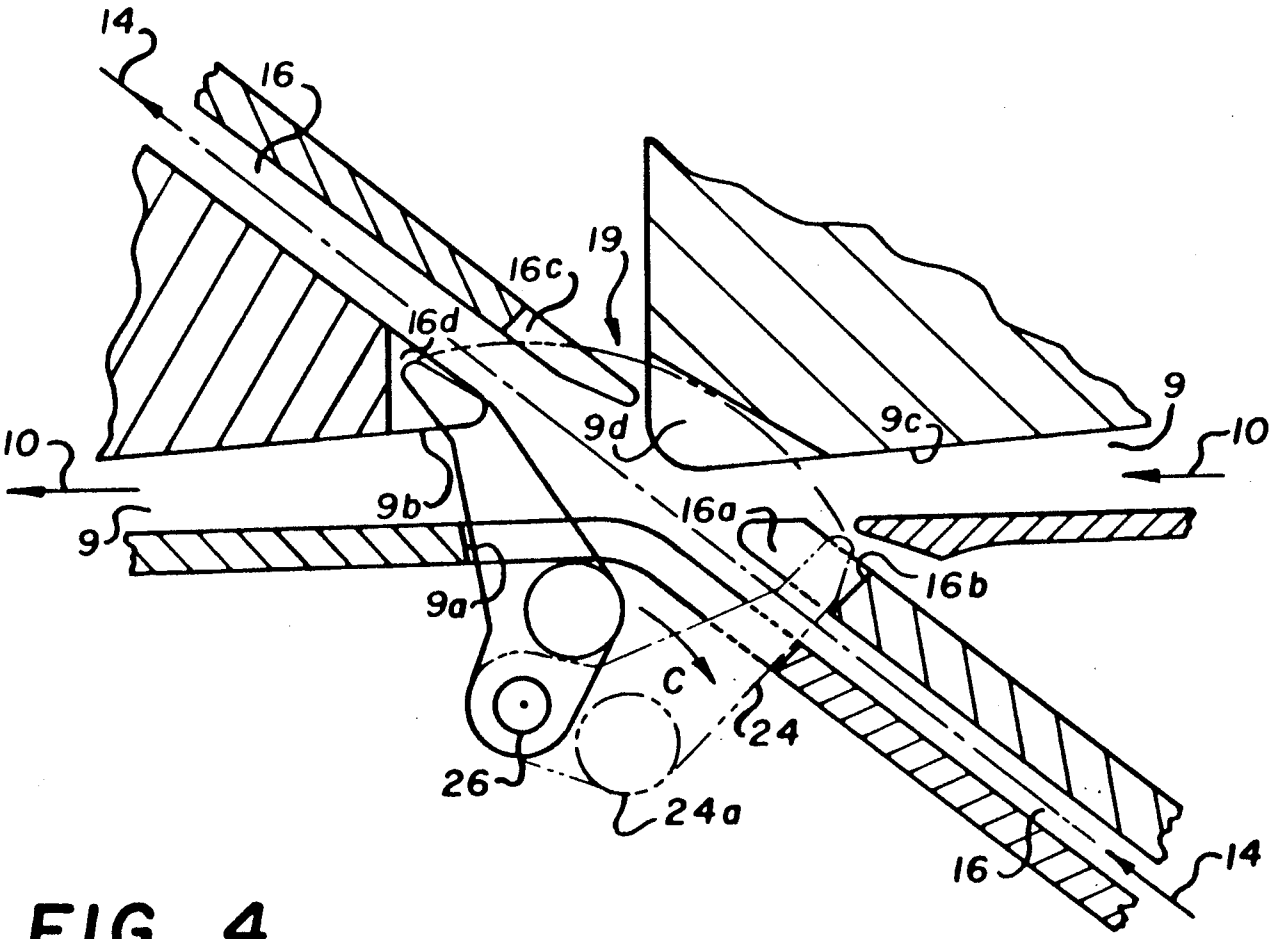
FIG. 4 is an enlarged partial view of the paper-guiding device functioning with sheets fed to a buckle-folding device.

The narrow guide channel 16, which is also referred to as the buckle plate, is arranged in an inclined position (see in particular FIGS. 1 and 2 which allow a particularly advantageous and space-saving arrangement within unit 1). However, due to this inclined position of guide channel 16 crossing guide channel 9, which extends substantially rectilinearly and along the shortest path possible transversely through unit 1, the danger exists at the point of intersection 19 of the two guide channels 9 and 16 that the sheets arriving in guide channel 16 in the direction of the arrow 14 do not pass the guide-free point of intersection 19 rectilinearly but escape in the direction of the arrow 10 into guide channel 9. This danger at the point of intersection 19 is due to the fact that guide channel 16 is arranged at an acute angle ($\alpha$) and that a funnel-type flared portion **9*b* (see FIGS. 3 and 4) of the transverse guide channel 9 is located in that area, which both serve to enlarge the guide-free area at the point of intersection 19. The funnel-shaped flared portion 9*b* is necessary to reliably guide the sheets supplied in the direction of the arrow 10 into guide channel 19 after they have passed the point of intersection 19. Moreover, guide channel 9 is provided with a funnel-shaped constriction 9*c* in front of the point of intersection 19 so that the sheets arriving in the direction of the arrow 10** are safely guided towards that point.

In order that the sheets arriving in the steeply inclined guide channel 16 in the direction of arrow 14 can also reliably and safely pass the point of intersection 19, deflectors 24 are provided which close the critical area on the funnel-shaped entry portion **9*b* of the transverse guide channel 9. The deflectors 24 are mounted for free pivotal movement about a stationary journal 26 and extend into the area of guide channel 16 in front of the point of intersection 19 such that they cover the channel completely. The deflectors 24 are preferably molded from plastic, for example. Preferably there are four deflectors distributed over the width of the sheets to be handled, which deflectors are independently rotatably and include thickened portions serving as weights 24*a* (see FIGS. 3 and 4). The weights 24*a* are disposed with respect to journal 26 such that the deflectors 24 are urged by gravity in the direction of the arrow "C" in any of their positions. The deflectors 24 and their weights 24*a*, which are mounted and/or arranged outside the guide channels 9 and 16, are each received in associated recesses 9*d*, 16*a*, 16*d* of the guide channels 9 and 16, respectively. In the initial position illustrated in FIGS. 1, 3 and 4 the deflectors 24 extend into the transport path of the sheets fed in the direction of the arrow 14 and, under the action of gravity, rest on end faces 16*b* of the recesses 16*a***.

The deflectors 24 function as follows: The lead edge of a sheet arriving in guide channel 16 in the direction of the arrow 14 contact deflector 24 and deflects it in opposition to the direction of the arrow "C" out of the position illustrated in FIG. 4. Deflector 24 is thus moved to the position indicated in dash-dotted lines in which it contacts an end face **9*a* of guide channel 9 and covers such channel in the critical area and forms a deflecting surface by which the guide channel 16 is connected across the point of intersection 19. In this manner, it is ensured that a sheet arriving in the direction of arrow 14 reliably passes the point of intersection 19 in a functionally correct manner and after such passage is again transported in the direction of arrow 14. Under the action of gravity the deflectors 24 return automatically to their initial positions as soon as the sheet concerned has left guide channel 16 in that area in opposition to the direction of arrow 14**.

In contrast to the illustrated embodiment where an additional control the deflectors 24 is not required, the deflectors 24 may alternatively be controlled electromechanically, for example, in response to the position of switch 8. If in the case of such a control, guide channel 7 has been cleared by switch 8, the deflectors 24 are electromechanically pivoted to the position shown in dash-dotted lines in which they close guide channel 9. In such case, all deflectors 24 are simultaneously pivoted by a common drive. They can be reset to the initial position illustrated in response to the actuation of switch 8, under the action of gravity, or by any other suitable control.

The invention has been described in detail with particular reference to a preferred embodiment thereof, but it will be understood that variations and modifications can be effected within the spirit and scope of the invention as set forth in the claims.

I claim:

1. Paper-guiding device for use in a finisher unit for copy sheets, in particular copy sheets fed seriatim to said finisher unit by a reproduction apparatus, said paper-guiding device comprising two rectilinear guide channels which join each other at an angle and in which the sheets are transported by driven rollers, said guide channels 9, 16 crossing each other at an acute angle ($\alpha$), and at least one pivotally mounted deflector 24 in the area of intersection 19 of the two guide channels 9, 16, said at least one deflector extending transversely to said channels normally covering one of said guide channels and pivotable into a position in which it clears said one guide channel 16 and closes said other of said guide channels, a weight associated with said at least one deflector, said weight being arranged outside the guide channels 9, 16 as well as between the journal 26 and the ends of the deflectors 24 which extend into the first guide channel 16.

2. The paper-guiding device according to claim 1, wherein said at least one deflector 24, due to said weight, extends under the action of gravity into the transport path of sheets guided in said first guide channel 16, and said at least one deflector 24 is pivotable in the direction of sheet transport 14 in said first guide channel to close said second guide channel.

3. The paper-guiding device according to claim 2, wherein said deflector 24, when in the position in which it closes said second guide channel 9, forms a guiding surface which connects said first guide channel 16 across said area of intersection 19.

4. The paper-guiding device according to claim 1, wherein said at least one deflector 24 is received in recesses 9*d*, 16*a*, 16*d* of the guide channels 9, 16.

5. The paper-guiding device according to claim 4, wherein said at least one deflector 24 rests, under the action of gravity, on end face 16*b* of the recess 16*a* of guide channel 16.

6. The paper-guiding device according to claim 1, wherein said second guide channel 9 includes a funnel-shaped constriction 9*c* directed at the point of intersection 19.

7. The paper-guiding device according to claim 6, wherein said second guide channel 9 includes the funnel-shaped flared portion 9*b* downstream of the point of intersection 19.

* * * * *

UNITED STATES PATENT AND TRADEMARK OFFICE

CERTIFICATE OF CORRECTION

PATENT NO. : 5,263,708

DATED : November 23, 1993

INVENTOR(S) : Frank Hacknauer

It is certified that error appears in the above-indentified patent and that said Letters Patent is hereby corrected as shown below:

Title page, item [57], Abstract, line 16, delete "16respectively" and substitute --16b respectively--.

Column 5, line 2, between "said" and "deflector" insert --at least one--.

Column 5, line 8, between "16a" and "16d" insert --16c--.

Signed and Sealed this

Thirtieth Day of January, 1996

*Attest:*

*Attesting Officer*

BRUCE LEHMAN

*Commissioner of Patents and Trademarks*